US006481141B1

(12) United States Patent
Wright

(10) Patent No.: US 6,481,141 B1
(45) Date of Patent: Nov. 19, 2002

(54) FIREARM SAFETY LOCK

(76) Inventor: John T. M. Wright, 555 S. Downing St., Denver, CO (US) 80209

( * ) Notice: Subject to any disclaimer, the term of this patent is extended or adjusted under 35 U.S.C. 154(b) by 0 days.

(21) Appl. No.: 09/784,477

(22) Filed: Feb. 15, 2001

(51) Int. Cl.[7] ..... F41A 17/00
(52) U.S. Cl. ..... 42/70.11
(58) Field of Search ..... 42/70.11, 96

(56) References Cited

U.S. PATENT DOCUMENTS 3,368,297 A * 2/1968 Lentz ..... 42/66
4,023,294 A 5/1977 Knopp
4,569,144 A 2/1986 Thurber
4,783,924 A 11/1988 Thurber
4,969,284 A * 11/1990 Healey et al. ..... 42/70.11
5,020,259 A * 6/1991 Mossberg ..... 42/70.11
5,044,106 A * 9/1991 Slocum ..... 211/64
5,241,770 A * 9/1993 Lambert ..... 42/70.11
5,271,174 A * 12/1993 Bentley ..... 42/70.11
5,860,241 A * 1/1999 Waters ..... 42/66
5,934,000 A * 8/1999 Hayes, Sr. ..... 15/104.2

* cited by examiner

*Primary Examiner*—Charles T. Jordan
*Assistant Examiner*—John W. Zerr
(74) *Attorney, Agent, or Firm*—Swanson & Bratschun LLC

(57) ABSTRACT

A firearm lock to prevent the firing of a firearm having a barrel comprising a rod having distal and proximal ends configured and constructed to extend into the barrel of a firearm and lock means on the distal end of the rod for preventing the removal of the rod from the barrel is disclosed.

2 Claims, 1 Drawing Sheet

FIREARM SAFETY LOCK

FIELD OF THE INVENTION

This invention relates to firearm safety devices. In particular, this invention relates to devices for preventing accidental discharge of firearms and for preventing unauthorized use of firearms.

BACKGROUND OF THE INVENTION

Each year many deaths occur from accidental discharge of firearms or the discharge of firearms by children or others who are not trained in the safe use of firearms. Many of these deaths occur when a loaded weapon is left unattended in a place accessible to children and others.

Considerable publicity has been given to the need for locking devices to prevent the accidental firing of a gun. Trigger locks, for example, are available, but trigger locks are not always effective in preventing the discharge of a gun.

The prior art discloses devices extending into or through the barrel of the gun to prevent discharge. For example, Knopp, U.S. Pat. No. 4,023,294, and Thurber, U.S. Pat. Nos. 4,569,144 and 4,783,924 disclose devices of this type in which particular manipulations are necessary to prepare the weapon to receive a round and to be discharged.

The present invention is a firearm lock mechanism that prevents the chambering of a round of ammunition in a firearm and a positive lock that provides protection against the use of a weapon equipped with the firearm lock of this invention.

SUMMARY OF THE INVENTION

The present invention is a firearm safety device to prevent the firing of a firearm having a barrel. In one embodiment, the invention comprises a rod having distal and proximal ends configured and constructed to extend into the barrel of a firearm such that the proximal end of the rod is positioned to prevent the chambering of a round of ammunition and lock engaging means on the distal end of the rod.

In another embodiment, the invention comprises a rod having distal and proximal ends configured and constructed to extend into the barrel of a firearm and lock engaging means on the distal end of the rod for being engaged by a removable lock for preventing the removal of the rod from the barrel.

In use the invention comprises the combination of a firearm having a barrel proximate the distal end and a rod having distal and proximal ends configured and constructed to extend into the barrel of a firearm and lock means on the distal end of the rod for being engaged by a removable lock for preventing the removal of the rod from the barrel.

BRIEF DESCRIPTION OF THE DRAWING

FIG. 1 also depicts the locking device of the embodiment of this invention wherein the locking device engages the forward sight of the firearm, the proximal end of the rod portion of the locking device extending into the firing chamber of the weapon to prevent the chambering of a round of ammunition.

DESCRIPTION OF THE PREFERRED EMBODIMENTS

The drawings and the following depict and describe only exemplary structures, and other structures within the general description and definition of the claims fall within the scope of the invention.

Figure 1:
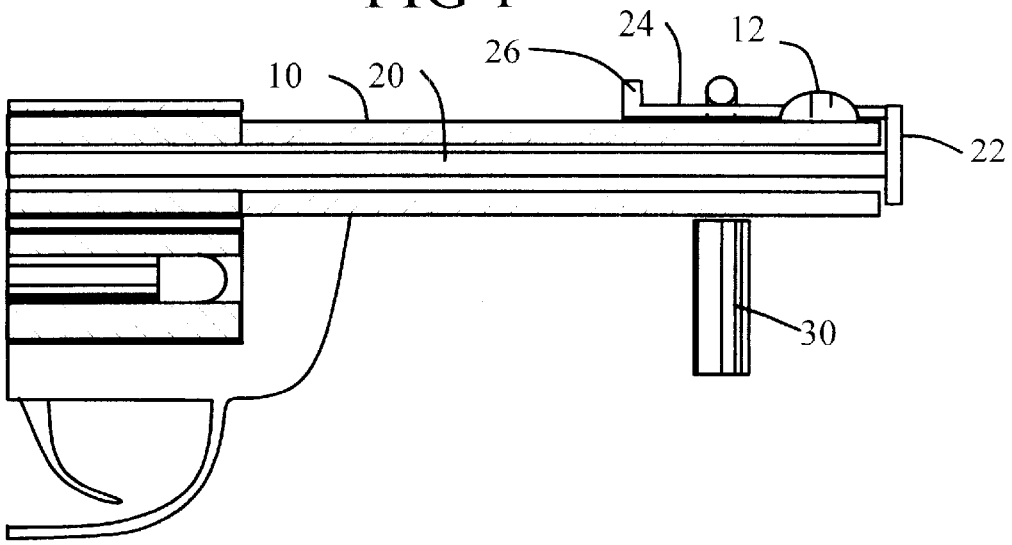
FIG. 1 depicts a portion of a firearm in partial cross-section, depicting in particular the distal end of the barrel and the sight on the distal end of the barrel. While the depiction is of a pistol, the weapon may also be a rifle.

Referring to FIG. 1, the drawing depicts the barrel 10 and sight 12 of a firearm. The depiction is exemplary in that while the barrel is comparatively short, as with an semi-automatic pistol. The barrel may, however, be longer, as with a rifle. The locking device 20 comprises a rod extending from the distal end of the barrel into the firing chamber of the firearm to prevent the chambering of a round of ammunition. The rod is preferably made of brass or some other material that will not score the barrel and may be of any length. The rod may be of steel coated with a polymer or other softer material to avoid damage to the barrel. The rod may also be extensible. For example, the rod may be a spring biased telescoping rod that is self-adjusting in length when inserted to extend completely into the firing chamber. The rod may be threadably received in or otherwise attached to a disk or other member 22 at the distal end of the barrel. In the threaded embodiment of the invention a kit may be sold with rods of different lengths for use in a variety of weapons.

The plate or member 22 is also secured to reverse extension 24 proximate the distal end of the rod but extending proximately upon which a lock engaging boss 26 is secured or formed toward the proximal extremity of the reverse extension from the distal end being selectively engaged by a padlock 30 on the proximal side of the gun sight. The safety devices of this invention thus may be described as a generally U shaped member comprising a rod for extending into the barrel of the gun, an end member, and a reverse extension having on it a lock engaging boss, the device being so configured and constructed that when a padlock of suitable size is locked with the hasp between the gun sight and the lock engaging boss the safety device cannot be removed from the gun.

When installed on a pistol or rifle, the locking device provides a high degree of safety because it is impossible to chamber a round of ammunition in the firing chamber for being fired.

The device is inexpensive and can be used with any padlock of appropriate size. The padlock may be a key lock or a combination lock.

Figure 2:
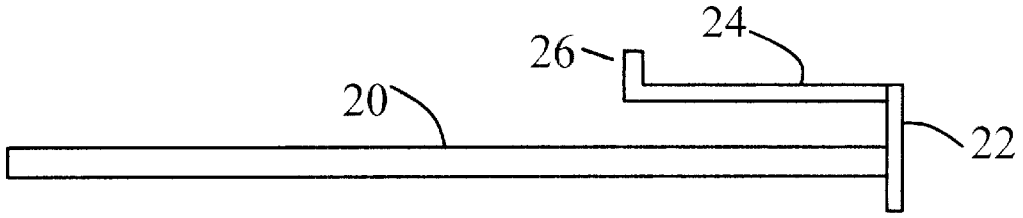
FIG. 2 depicts the device of this invention separated from the combination invention, the combined firearm and safety device.

The elegant simplicity of the device is illustrated in FIG. 2.

The essential elements of this invention are the rod for extending into the barrel and the means for locking the rod in the barrel. The material and configuration of these elements is, of course, subject to great variability.

INDUSTRIAL APPLICATION

This invention is useful in the firearms industry.

What is claimed is:

1. A firearm lock to prevent a firearm from being fired, said firearm comprising a barrel and a gun sight located on said barrel, wherein said firearm lock comprises a generally U-shaped structure comprising:

a rod for extending into said barrel;

an end member; and a reverse extension comprising a lock engaging boss;

said firearm lock being so configured and constructed that when a padlock of suitable size comprising a hasp is locked with said hasp locked around said barrel and said reverse extension between said gun sight and said lock engaging boss, said firearm lock cannot be removed from said firearm.

2. In combination, (i) a firearm comprising a barrel and a gun sight located on said barrel;

(ii) a generally U shaped member, comprising a rod extending into said barrel, an end member, and a reverse extension having a lock engaging boss; and (iii) a padlock comprising a hasp, said hasp locked around said barrel and said reverse extension with said hasp located between said gun sight and said lock engaging boss;

wherein said U shaped member is so configured and constructed and said padlock is so sized that said rod cannot be removed from said barrel.

* * * * *